US008801372B2

(12) United States Patent
Shi et al.

(10) Patent No.: US 8,801,372 B2
(45) Date of Patent: Aug. 12, 2014

(54) TURBINE SHROUD THERMAL DISTORTION CONTROL

(71) Applicant: United Technologies Corporation, Hartford, CT (US)

(72) Inventors: Jun Shi, Glastonbury, CT (US); Kevin E. Green, Broad Brook, CT (US); Shaoluo L. Butler, Manchester, CT (US); Gajawalli V. Srinivasan, South Windsor, CT (US); Glenn N. Levasseur, Colchester, CT (US)

(73) Assignee: United Technologies Corporation, Hartford, CT (US)

( * ) Notice: Subject to any disclaimer, the term of this patent is extended or adjusted under 35 U.S.C. 154(b) by 29 days.

(21) Appl. No.: 13/668,733

(22) Filed: Nov. 5, 2012

(65) Prior Publication Data

US 2013/0094946 A1 Apr. 18, 2013

Related U.S. Application Data

(62) Division of application No. 13/308,269, filed on Nov. 30, 2011, now Pat. No. 8,328,505, which is a division of application No. 12/617,425, filed on Nov. 12, 2009, now Pat. No. 8,092,160, which is a division of application No. 11/502,079, filed on Aug. 10, 2006, now Pat. No. 7,665,960.

(51) Int. Cl.
*F01D 11/18* (2006.01)

(52) U.S. Cl.
USPC ..... 415/173.1

(58) Field of Classification Search
USPC ..... 415/134, 135, 138, 173.1
See application file for complete search history.

(56) References Cited

U.S. PATENT DOCUMENTS

| | | | | |
|---|---|---|---|---|
| 3,295,824 | A | | 1/1967 | Woodwell et al. |
| 3,672,162 | A | * | 6/1972 | Rygelis et al. ..... 60/800 |
| 3,825,364 | A | | 7/1974 | Halila et al. |
| 3,843,279 | A | | 10/1974 | Crossley et al. |
| 3,869,222 | A | | 3/1975 | Rahnke et al. |
| 3,901,622 | A | | 8/1975 | Ricketts |
| 4,008,978 | A | | 2/1977 | Smale |
| 4,076,451 | A | | 2/1978 | Jankot |
| 4,087,199 | A | | 5/1978 | Hemsworth et al. |
| 4,398,866 | A | | 8/1983 | Hartel et al. |

(Continued)

FOREIGN PATENT DOCUMENTS

| | | | |
|---|---|---|---|
| EP | 0 492 865 | A1 | 7/1992 |
| EP | 1 516 322 | A1 | 12/1992 |

(Continued)

OTHER PUBLICATIONS

Partial European Search Report for EP Application Serial No. 07253091.8; dated Aug. 9, 2011, 5 pages.

(Continued)

*Primary Examiner* — Ninh H Nguyen
(74) *Attorney, Agent, or Firm* — Kinney & Lange, P.A.

(57) ABSTRACT

A shroud for a gas turbine engine includes a leading portion having a leading edge and a first set of circumferentially spaced slots at the leading edge that break up the leading portion into circumferentially spaced segments separated by the first set of slots, and a trailing portion adjacent to the leading portion. The trailing portion has a trailing edge.

17 Claims, 6 Drawing Sheets

(56) References Cited

U.S. PATENT DOCUMENTS

| | | | | |
|---|---|---|---|---|
| 4,411,594 | A | 10/1983 | Pellow et al. | |
| 4,413,470 | A * | 11/1983 | Scheihing et al. | 60/800 |
| 4,413,477 | A * | 11/1983 | Dean et al. | 60/757 |
| 4,439,981 | A | 4/1984 | Weiler et al. | |
| 4,502,809 | A | 3/1985 | Geary | |
| 4,522,557 | A | 6/1985 | Bouiller et al. | |
| 4,639,194 | A | 1/1987 | Bell, III et al. | |
| 4,643,638 | A | 2/1987 | Laurello | |
| 4,650,395 | A | 3/1987 | Weidner | |
| 4,669,954 | A | 6/1987 | Habarou et al. | |
| 4,676,715 | A | 6/1987 | Imbault et al. | |
| 4,679,981 | A | 7/1987 | Guibert et al. | |
| 4,684,320 | A | 8/1987 | Kunz | |
| 4,759,687 | A | 7/1988 | Miraucourt et al. | |
| 4,907,946 | A | 3/1990 | Ciokajlo et al. | |
| 4,925,365 | A | 5/1990 | Crozet et al. | |
| 5,080,557 | A | 1/1992 | Berger | |
| 5,088,775 | A * | 2/1992 | Corsmeier et al. | 285/374 |
| 5,167,487 | A | 12/1992 | Rock | |
| 5,169,287 | A | 12/1992 | Proctor et al. | |
| 5,181,826 | A | 1/1993 | Rock | |
| 5,279,031 | A | 1/1994 | Carruthers et al. | |
| 5,333,992 | A | 8/1994 | Kane et al. | |
| 5,368,095 | A | 11/1994 | Kadambi et al. | |
| 5,439,348 | A | 8/1995 | Hughes et al. | |
| 5,486,090 | A | 1/1996 | Thompson et al. | |
| 5,562,408 | A | 10/1996 | Proctor et al. | |
| 5,609,469 | A | 3/1997 | Worley et al. | |
| 6,048,170 | A | 4/2000 | Dodd | |
| 6,139,257 | A | 10/2000 | Proctor et al. | |
| 6,142,731 | A | 11/2000 | Dewis et al. | |
| 6,164,656 | A | 12/2000 | Frost | |
| 6,250,883 | B1 | 6/2001 | Robinson et al. | |
| 6,340,285 | B1 | 1/2002 | Gonyou et al. | |
| 6,354,795 | B1 | 3/2002 | White et al. | |
| 6,368,054 | B1 | 4/2002 | Lucas | |
| 6,659,716 | B1 | 12/2003 | Laurello et al. | |
| 6,733,233 | B2 | 5/2004 | Jasklowski et al. | |
| 6,758,653 | B2 | 7/2004 | Morrison | |
| 6,869,082 | B2 * | 3/2005 | Parker | 277/630 |
| 6,910,853 | B2 | 6/2005 | Corman et al. | |
| 6,926,495 | B2 * | 8/2005 | Diakunchak | 415/173.3 |
| 6,932,566 | B2 | 8/2005 | Suzumura et al. | |
| 6,942,445 | B2 | 9/2005 | Morris et al. | |
| 6,997,673 | B2 | 2/2006 | Morris et al. | |
| 7,008,183 | B2 | 3/2006 | Sayegh et al. | |
| 7,033,138 | B2 | 4/2006 | Tomita et al. | |
| 7,040,857 | B2 | 5/2006 | Chiu et al. | |
| 7,117,983 | B2 | 10/2006 | Good et al. | |
| 7,140,836 | B2 | 11/2006 | Balsdon | |
| 7,189,059 | B2 * | 3/2007 | Barton et al. | 415/186 |
| 7,290,982 | B2 | 11/2007 | Girard et al. | |
| 7,367,776 | B2 * | 5/2008 | Albers et al. | 415/173.1 |
| 7,530,782 | B2 * | 5/2009 | Barnett et al. | 415/119 |
| 7,771,160 | B2 | 8/2010 | Shi et al. | |
| 8,167,546 | B2 | 5/2012 | Shi et al. | |
| 2001/0021343 | A1 | 9/2001 | Kuwabara et al. | |
| 2005/0232752 | A1 | 10/2005 | Meisels | |
| 2008/0010990 | A1 | 1/2008 | Shi et al. | |
| 2009/0272122 | A1 | 11/2009 | Shi et al. | |
| 2010/0010443 | A1 | 1/2010 | Morgan et al. | |
| 2012/0224949 | A1 | 9/2012 | Harper et al. | |

FOREIGN PATENT DOCUMENTS

| | | | |
|---|---|---|---|
| EP | 1 890 010 | A2 | 2/2008 |
| GB | 2397102 | A | 7/2004 |
| JP | 53-65516 | A | 6/1978 |
| JP | 61-135905 | A | 6/1986 |
| JP | 63-11242 | A | 1/1988 |
| JP | 63-40776 | A | 2/1988 |
| JP | 2211960 | A | 8/1990 |
| JP | 4119225 | A | 4/1992 |
| JP | 9228804 | A2 | 9/1997 |
| JP | 2004176911 | A | 6/2004 |

OTHER PUBLICATIONS

Extended European Search Report for EP Application Serial No. 07253091.8; dated Dec. 8, 2011, 10 pages.

Jimenez, O., Mclain, J., Edwards, B., Parthasasathy, V., Bagheri, H. And Bolander, G., "Ceramic Stationary Gas Turbine Development Program-design and Test of a Ceramic Turbine Blade," ASME 98-GT-529, International Gas Turbine and Aeroengine Congress and Exhibition, Stockholm, Sweden, 1998, (pp. 1-9).

Norton, Frey, G. A., Bagheri, H., Flerstein, A., Twardochieb, C., Jimenez, O., and Saith, A., "Ceramic Stationary Gas Turbine Development Program-Design and Life Assessment of Ceramic Components," ASME Paper 95-GT-383, International Gas Turbine and Aeroengine Congress and Exhibition, Houston, Texas, 1995, (pp. 1-9).

Sinnet, G.T., French, J.M. And Groseciose, L.E., "Progress on the Hybrid Vehicle Turbine Engine Technology Support (HVTE-TS) Program," ASME Paper 97-GT-88, International Gas Turbine and Aeroengine Congress and Exhibition, Orlando, Florida, 1997, (pp. 1-13).

* cited by examiner

TURBINE SHROUD THERMAL DISTORTION CONTROL

CROSS-REFERENCE TO RELATED APPLICATION(S)

This application is a divisional of Ser. No. 13/308,269, filed Nov. 30, 2011, now U.S. Pat. No. 8,328,505, which is a divisional of Ser. No. 12/617,425, filed Nov. 12, 2009, now U.S. Pat. No. 8,092,160, which is a divisional of Ser. No. 11/502,079, filed Aug. 10, 2006, now U.S. Pat. No. 7,665,960. Reference is made to a U.S. patent application entitled CERAMIC SHROUD ASSEMBLY, Ser. No. 11/502,212, filed on Aug. 10, 2006, now U.S. Pat. No. 7,771,160.

STATEMENT OF GOVERNMENT INTEREST

This invention was made with Government support under contract number W31P4Q-05-D-R002, awarded by the U.S. Army Aviation and Missile Command Operation and Service Directorate. The U.S. Government has certain rights in this invention.

BACKGROUND

The present invention relates to an outer shroud for use in a gas turbine engine. More particularly, the present invention relates to a means for achieving substantially uniform thermal growth of an outer shroud.

In a gas turbine engine, a static shroud is disposed radially outwardly from a turbine rotor, which includes a plurality of blades radially extending from a disc. The shroud ring at least partially defines a flow path for combustion gases as the gases pass from a combustor through turbine stages. Typically, there is a gap between the shroud ring and rotor blade tips in order to accommodate thermal expansion of the blade during operation of the gas turbine engine. The size of the gap changes during engine operation as the shroud and rotor blades thermally expand in a radial direction in reaction to high operating temperatures. It is generally desirable to minimize the gap between a blade tip and shroud ring in order to minimize the percentage of hot combustion gases that leak through the tip region of the blade. The leakage reduces the amount of energy that is transferred from the gas flow to the turbine blades, which may penalize engine performance. This is especially true for smaller scale gas turbine engines, where tip clearance is a larger percentage of the combustion gas flow path.

Many components in a gas turbine engine, such as a turbine blade and shroud, operate in a non-uniform temperature environment. The non-uniform temperature causes the components to grow unevenly and in some cases, lose their original shape. In the case of a shroud, such uneven deformation may affect the performance of the gas turbine engine because the tip clearance increases as the shroud expands radially outward (away from the turbine blades).

SUMMARY

A shroud for a gas turbine engine includes a leading portion having a leading edge and a first set of circumferentially spaced slots at the leading edge that break up the leading portion into circumferentially spaced segments separated by the first set of slots, and a trailing portion adjacent to the leading portion. The trailing portion has a trailing edge.

DETAILED DESCRIPTION

In the present invention, a shroud of a gas turbine engine exhibits substantially uniform thermal growth during operation of the gas turbine engine. Substantially uniform thermal growth may help increase gas turbine efficiency by minimizing a clearance between the shroud and turbine blade tips.

Figure 1:
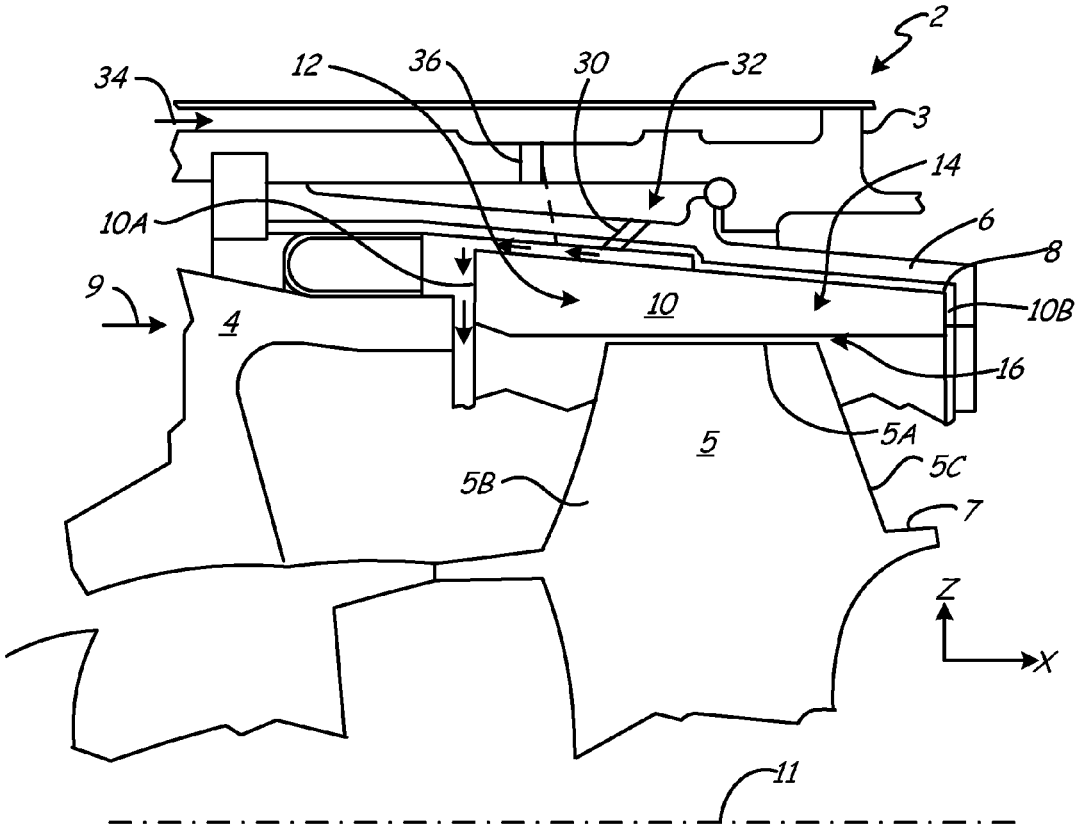
FIG. 1 is a partial schematic cross-sectional view of gas turbine engine turbine stage, illustrating a first embodiment of achieving uniform thermal growth of a shroud, where a leading edge of the shroud is impingement cooled and the trailing edge is thermally insulated.

FIG. 1 illustrates a partial schematic cross-sectional view of turbine stage 2 of a gas turbine engine, which includes turbine engine casing 3, nozzle vanes 4 (which are circumferentially arranged about axis 11 and within casing 3), turbine blade 5 (which is one of a plurality of blades) radially extending from a rotor disc (not shown), metal support ring 6, which is attached to turbine engine casing 3, platform 7, interlayer 8, and static shroud 10. Turbine blades 5 each include blade tip 5A, leading edge 5B, and trailing edge 5C. Metal support ring 6 couples shroud 10 to casing 3, and is attached to shroud 10 using any suitable method, such as, but not limited to, fasteners, or an interference fit, as described in U.S. patent application Ser. No. 11/502,212, entitled, "CERAMIC SHROUD ASSEMBLY," which was filed on the same date as the priority application U.S. patent application Ser. No. 11/502,079. Compliant interlayer 8 is positioned between metal support ring 6 and shroud 10, and allows for relative thermal growth therebetween. Compliant layer 8 also thermally insulates metal support ring 6 from shroud 10, which may exhibit a high temperature due to hot combustion gases to which shroud 10 is exposed, as described in U.S. patent application Ser. No. 11/502,212, entitled, "CERAMIC SHROUD ASSEMBLY."

During operation of the gas turbine engine, hot gases from a combustion chamber (not shown) enter first high pressure turbine stage 2 and move in a downstream/aft direction (indicated by arrow 9) past nozzle vanes 4. Nozzle vanes 4 direct the flow of hot gases past rotating turbine blades 5, which radially extend from a rotor disc (not shown), as known in the art. As known in the art, shroud assembly 10 defines an outer boundary of a flow path for hot combustion gases as they pass from the combustor through turbine stage 2, while platform 7 positioned on an opposite end of blades 5 from shroud assembly 10 defines an inner flow path surface.

Shroud 10 extends from leading edge 10A (also known as a front edge) to trailing edge 10B (also known as an aft edge), and includes backside 10C and front side 10D (FIG. 3A), where front side 10D is closest to the leading edge of blade 5. Leading edge 10A and trailing edge 10B are positioned on axially opposite sides of shroud 10, and as known in the art, leading edge 10A is generally the front edge of shroud 10 (i.e., closest to the front of the gas turbine engine), while trailing edge 10B is the aft edge of shroud 10. Backside 10C and front side 10D of shroud 10 are positioned on opposite sides of shroud 10. Leading portion 12 of shroud 10 is adjacent to leading edge 10A and trailing portion 14 is adjacent to trailing edge 10B.

Orthogonal x-z axes are provided in FIG. 1. The z-axis direction represents a radial direction (with respect to gas turbine engine centerline, which is schematically represented by line 11), while the x-axis direction represents an axial direction. When shroud 10 thermally expands, shroud 10 expands in a radial outward direction (i.e., away from centerline 11).

As described in the Background, clearance 16 between blade tip 5A and shroud 10 accommodates thermal expansion of blade 5 in response to high operating temperatures in turbine stage 2. Considerations when establishing clearance 16 include the expected amount of thermal expansion of blade 5, as well as the expected amount of thermal expansion of shroud 10. Clearance 16 should be approximately equal to the distance that is necessary to prevent blade 5 and shroud 10 from contacting one another. When shroud 10 thermally expands radially outward, clearance 16 between blade tip 5A shroud 10 increases if the thermal expansion of shroud 10 is greater than the thermal expansion of blade 5. It is generally desirable to minimize clearance 16 between blade tip 5A and shroud 10 in order to minimize the percentage of hot combustion gases that leak through tip 5A region of blade 5, which may penalize engine performance.

Uneven thermal growth of shroud 10 may adversely affect clearance 16, and cause clearance 16 in some regions to be greater than others. It has been found that shroud 10 undergoes uneven thermal growth for at least two reasons. First, leading portion 12 of shroud 10 may be exposed to higher operating temperatures than trailing portion 14, which may cause shroud leading portion 12 to encounter more thermal growth than trailing portion 14. Turbine blade 5 extracts energy from hot combustion gases, and as a result of the energy extraction, the combustion gas temperature decreases from blade leading edge 5B to trailing edge 5C. This drop in temperature between blade leading edge 5B and trailing edge 5C may impart an uneven heat load to shroud 10 because combustion gas transfers heat to shroud 10. More heat is transferred to leading portion 12 of shroud, because leading portion 12 is adjacent to hotter combustion gas at the blade leading edge 5B, which is exposed to higher temperature combustion gases than blade trailing edge 5C. If shroud 10 experiences such uneven operating temperatures, shroud 10 leading portion 12 encounters more thermal growth than shroud 10 trailing portion 14, which may create a larger clearance between shroud 10 and blade tip 5A (shown in FIG. 1) at shroud 10 leading portion 12.

Figure 2A:
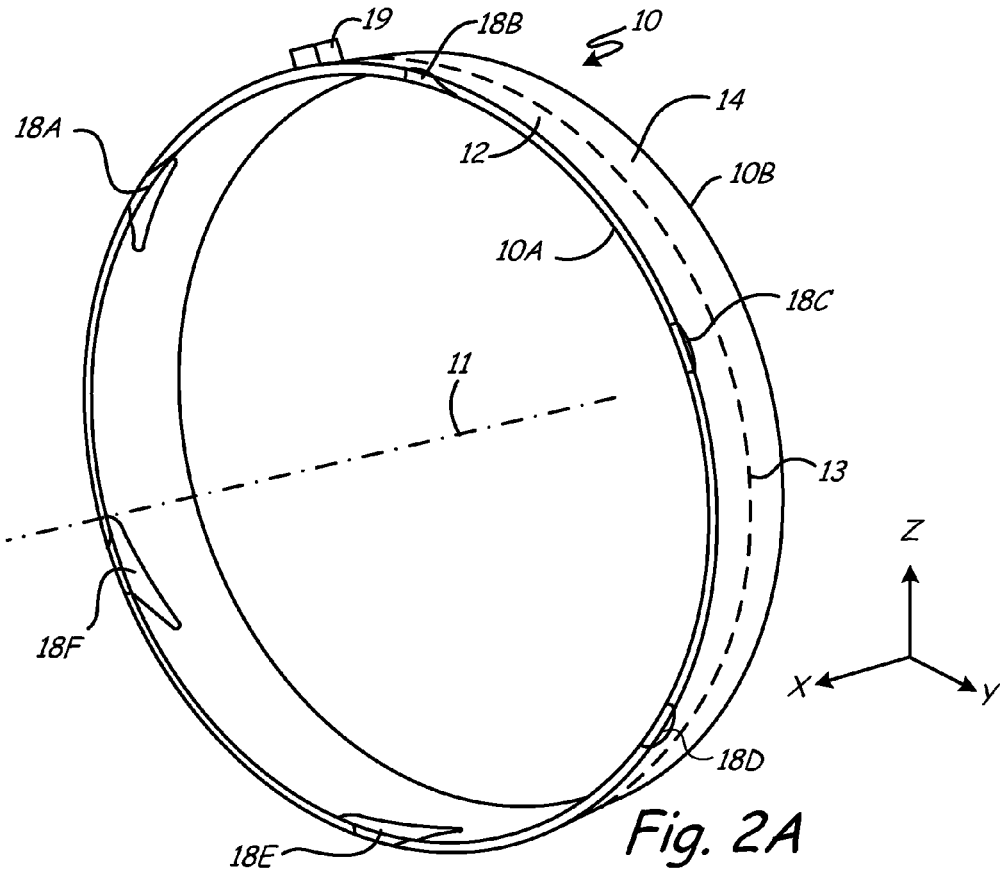
FIG. 2A is a perspective view of a shroud suitable for use in a gas turbine engine, illustrating a temperature distribution across the shroud during operation of the gas turbine engine.

FIG. 2A is a perspective view of shroud 10, which is a continuous ring of material. FIG. 2A also illustrates leading edge 10A, trailing edge 10B, leading portion 12, and trailing portion 14 (which is separated from leading portion 12 by phantom line 13, which is approximately axially centered with respect to shroud 10). Orthogonal x-y-z axes are provided in FIG. 2A. The z and y-axes directions represent a radial direction with respect to gas turbine engine centerline 11, while the x-axis direction represents an axial direction. A second reason shroud 10 may undergo uneven thermal growth is because of a circumferential variation in temperature of shroud 10 in response to combustor exit patterns (i.e., the flow of hot gases from the combustor and to the turbine stage). Specifically, "hot spots" 18A, 18B, 18C, 18D, 18E, and 18F (collectively 18A-18F) are regions of shroud 10 that are exposed to higher temperatures than the remainder of shroud 10 due combustor gas exit patterns. Hot spots 18A-18F may lead to non-uniform circumferential thermal growth. While six hot spots 18A-18F are illustrated in FIG. 2A, in alternate embodiments, shroud 10 may include any number of hotspots, which generally correspond to the exit pattern of the combustor of the particular gas turbine engine into which shroud 10 is incorporated. Although shroud 10 is shown to be a continuous ring shroud, the same principles of non-uniform circumferential growth also apply to a segmented ring shroud (i.e., multiple shroud segments forming a ring).

Figure 2B:
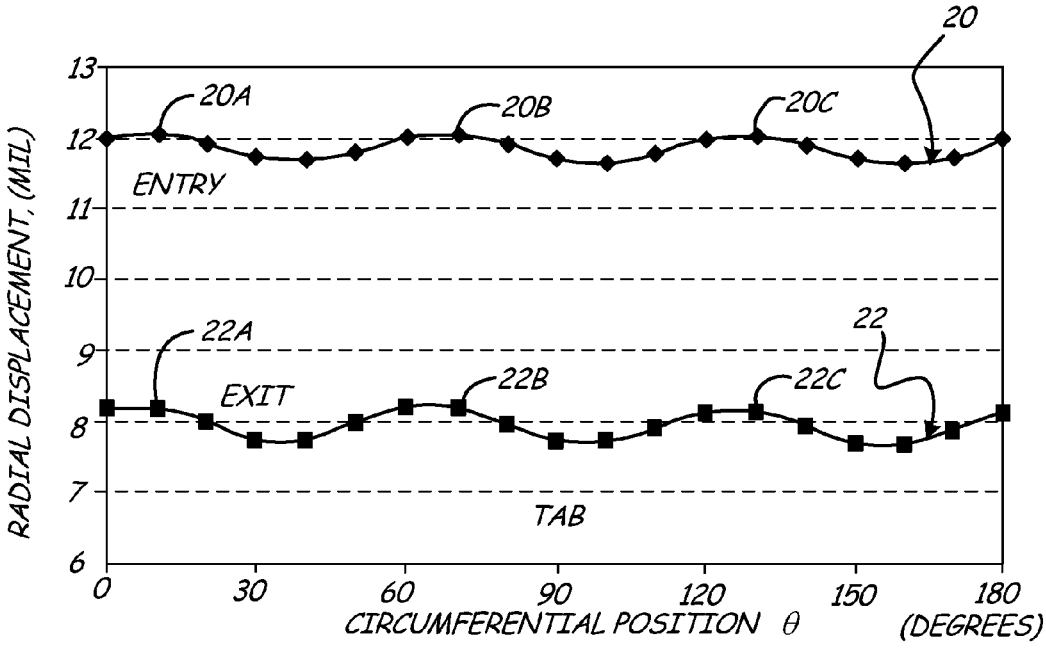
FIG. 2B is a graph illustrating the radial displacement of the shroud of FIG. 2A as a function of the circumferential position.

FIG. 2B is a graph illustrating the radial displacement of shroud 10 as a function of the circumferential position, which equals 90° at tab 19 (shown in FIG. 2A). Tab 19 is used as a reference point for the graph illustrated in FIG. 2B and is not intended to limit the present invention in any way. Circumferential locations from 0° to 180° of shroud 10 are represented in FIG. 2B, which encompasses hot spots 18A-18C. As FIG. 2B illustrates, the radial displacement of shroud 10 varies according to the approximate location of hot spots 18A-18C. Line 20 represents the radial displacement of leading edge 10A of shroud 10, while line 22 represents the radial displacement of trailing edge 10B. Points 20A of line 20 and 22A of line 22 correspond to hot spot 18A, and illustrate the increased radial displacement due to the increased temperature at hot spot 18A. Similarly, points 20B and 22B correspond to an increased radial displacement at hotspot 18B, and points 20C and 22C correspond to an increased radial displacement at hotspot 18C.

Returning now to FIG. 1, in a first embodiment, uniform thermal growth of shroud 10 is achieved by impingement cooling leading portion 12 of shroud 10, while thermally insulating trailing portion 14. In existing gas turbine engines, cooling air is bled from the compressor stage and routed to the turbine stage in order to cool various components. One of the components cooled in current designs is trailing portion 14 of shroud 10, which causes trailing portion 14 to be significantly cooler than leading portion 12. In response, leading edge 10A of shroud 10 may curl up in a radially outward direction, which causes tip clearance 16 to increase. This is an undesirable result. The first embodiment addresses the problems with existing shroud cooling systems by reducing the backside cooling and the attendant through thickness temperature gradient that causes curl-up.

In the first embodiment, an inventive cooling system includes directing cooling air toward leading portion 12 of shroud 10 through cooling holes 30 in metal support 6, as indicated by arrow 32. More specifically, the cooling air is bled from the compressor section (using a method known in the art) through flow path 34, through cooling holes 36 in casing 3, and through cooling holes 30 in metal support 6. The cooling air then flows across leading portion 12 of shroud 10 and across leading edge 10A of shroud 10. In one embodiment, cooling air from cooling holes 30 in metal support 6 is directed at aft side of leading portion 12 of shroud 10. Cooling leading portion 12 of shroud 10 helps even out the axial temperature variation across shroud 10 because leading portion 12 is typically exposed to higher operating temperatures than trailing portion 14. Although a cross-section of turbine stage 2 is illustrated in FIG. 1, it should be understood that multiple cooling holes 30 are circumferentially disposed about metal support 6 and multiple cooling holes 36 are disposed about casing 3, in order to cool the full hoop of the shroud backside (or OD).

Circumferential temperature variation of shroud 10 may also be addressed by actively cooling hotspots 18A-18F (shown in FIG. 2A) by positioning cooling holes 32 in metal support 6 and interlayer 8 to direct cooling air at hotspots 18A-18F.

It was also found that thermally insulating trailing portion 14 further helped achieve an even axial temperature distribution across shroud 10. In the embodiment illustrated in FIG. 1, trailing portion 14 is insulated by interlayer 8, which overlays trailing portion 14 (including trailing edge 10B). Interlayer 8 may be formed of a thermal insulator such as mica sold under the trade designation COGETHERM and made by Cogeby. In an alternate embodiment, interlayer 8 may be a thermal barrier coating, such as, but not limited to, yttria stabilized zirconia. Trailing portion 14 can be cooled, if needed, by convective cooling.

Figure 3A:
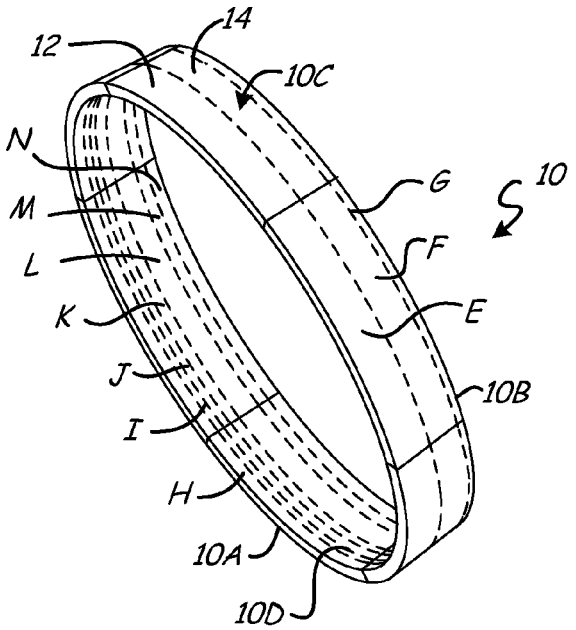
FIG. 3A is a representation of a finite element prediction of a temperature distribution across the shroud of FIG. 1 during a steady-state operation of a gas turbine engine.

FIG. 3A is a representation of a finite element prediction of temperature of shroud 10 during a steady-state operation of a gas turbine engine, when leading portion 12 of shroud 10 is impingement cooled and trailing portion 14 is thermally insulated in accordance with the first embodiment. As previously stated, backside 10C of shroud 10 is the side of shroud 10 that is furthest from the hot combustion gases, while front side 10D is the radially opposite side of shroud 10 and closest to the hot combustion gases. Along backside 10C of shroud 10, region E exhibited a temperature of about 958° C. (1757° F.), region F about 995-1007° C. (1824-1846° F.), and region G about 983° C. (1802° F.). The prediction of the temperature variation along backside 10C of shroud 10 illustrates that directly cooling leading portion 12 helps lower the temperature along leading portion 12. Because the temperature distribution along backside 10C is altered such that leading portion 12 along backside 10C exhibits a lower temperature than trailing portion 14, backside 10C of leading portion 12 experiences less thermal growth than backside 10C of trailing portion 14.

Along front side 10D of shroud 10, region H exhibited a temperature of about 1057° C. (1936° F.), region I about 1045° C. (1914° F.), region J about 1032° C. (1891° F.), region K about 1020° C. (1869° F.), region L about 1007° C. (1846° F.), region M about 995° C. (1824° F.), and region N about 983° C. (1802° F.). Along front side 10D, leading portion 12 exhibits a higher temperature than trailing portion 14 because the cooling is directed at backside 10C of leading portion 12. As a result of the higher temperature along front side 10D of leading portion 12, front side 10D of leading portion 12 is inclined to experience more thermal growth than front side 10D of trailing portion 14. However, because backside 10C of leading portion 12 does not experience as much thermal growth as backside 10C of trailing portion 14, the thermal growth along front side 10D and backside 10C of shroud 10 work together to achieve substantially uniform thermal growth of shroud 10. Furthermore, the cooler temperature along backside 10C of leading portion 12 helps restrain thermal growth along front side 10D of leading portion 12.

Figure 3B:
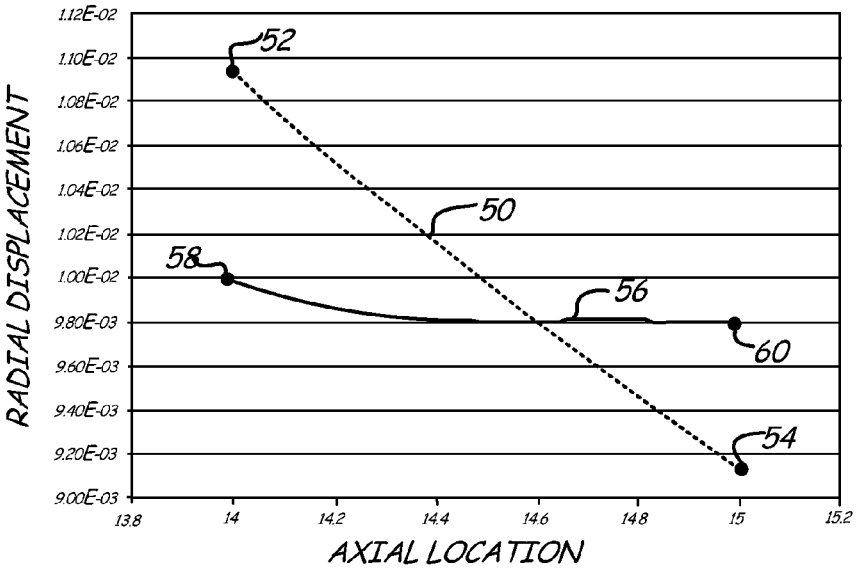
FIG. 3B is a graph illustrating the radial displacement of the shroud of FIG. 1 as a function of an axial (x-axis) location along the shroud as compared to a prior art design that directs cooling air over the whole back surface (or OD) of the shroud.

FIG. 3B is a graph illustrating the radial displacement of shroud 10 as a function of an axial location along shroud 10 as compared to a prior art shroud including cooling directed at the trailing edge of the shroud. Line 50 represents the radial displacement of the prior art shroud, where point 52 corresponds to the leading edge and point 54 corresponds to the trailing edge. As line 50 demonstrates, the prior art shroud exhibits greater radial displacement at leading edge 52 than trailing edge 54. Line 56 represents the radial displacement of shroud 10 (including impingement cooling directed at leading portion 12 and insulated trailing portion 14), where point 58 corresponds to leading edge 10A and point 60 corresponds to trailing edge 10B. As line 56 demonstrates, shroud 10 in accordance with the first embodiment exhibits substantially even radial displacement. FIG. 3B demonstrates that the first embodiment achieves substantially uniform thermal growth of shroud 10 as compared to the prior art method of directly cooling a trailing edge of a shroud.

Figure 4A:
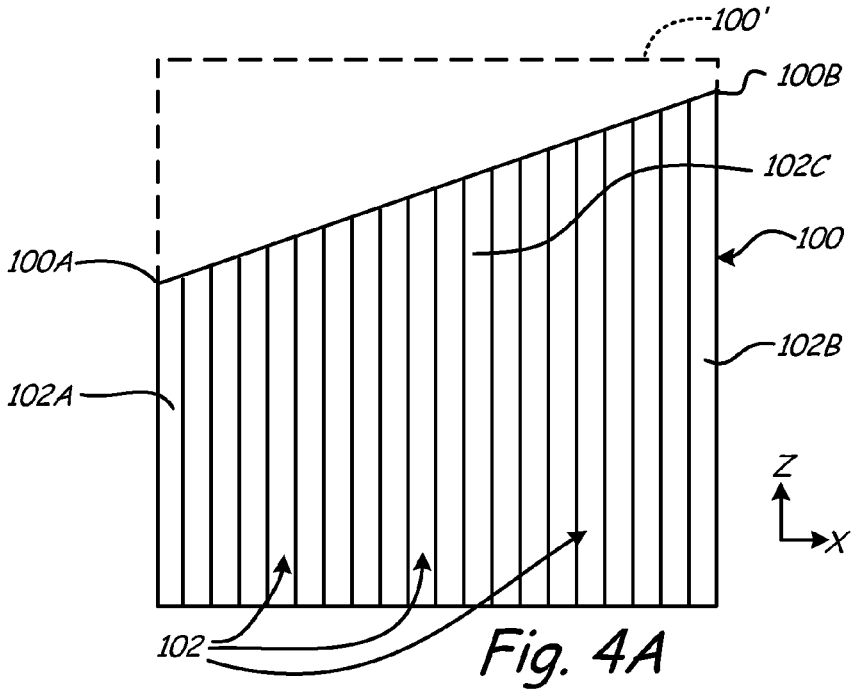
FIG. 4A is a cross-sectional view of a second embodiment of achieving substantially uniform thermal growth, where a coefficient of thermal expansion of the shroud increases from a leading edge to a trailing edge.

FIG. 4A is a cross-sectional view of a second embodiment of achieving substantially uniform thermal growth, where a coefficient of thermal expansion (CTE) of shroud 100 increases from leading edge 100A to trailing edge 100B. Orthogonal x-z axes are provided in FIG. 4A (which correspond to the orthogonal x-y-z axes shown in FIG. 2A) to illustrate the cross-section of shroud 100. Shroud 100 exhibiting a CTE that increases from leading edge 100A to trailing edge 100B may be formed by any suitable method, such as by depositing a plurality of layers having different CTE values, or gradually increasing the percentage of a high CTE material as the material for shroud 100 is deposited. In shroud 100 illustrated in FIG. 4A, plurality layers 102 of ceramic material are deposited, with each succeeding layer of material having a greater CTE value than the previously deposited layer of material. Layer 102A is closest to leading edge 100A of shroud 100, layer 102B is closest to trailing edge 102B, and layer 102C is approximately midway between layers 102A and 102B. In alternate embodiments, two adjacent layers may have the same or similar CTE values. In one embodiment, material forming leading edge layer 102A exhibits a CTE that is about 10% lower than material forming mid-layer 102C, and material forming trailing edge layer 102B is about 10% higher than material forming mid-layer 102C.

In one method of forming shroud 100, each layer 102 includes a different ratio of a first material having a high CTE and a second material having a low CTE. The ratios are adjusted to achieve the different CTE values. In one embodiment, the first material having a high CTE may be silicon carbide, while the second material having a lower CTE may be silicon nitride. In such an embodiment, layer 102A may be pure silicon nitride, while layer 102B is pure silicon carbide. In an embodiment where shroud 100 may be formed of a single layer rather than multiple discrete layers, the single layer is formed by varying the composition of the ceramic material as the ceramic material is deposited. In one embodiment, the composition of the single layer is varied such that the material at leading edge 100A exhibits a CTE that is about 20% lower than material at trailing edge 100B.

As known, the amount of thermal expansion/growth is related to the CTE and temperature. Varying the CTE of shroud 100 helps achieve substantially uniform thermal growth by compensating for temperature variation from leading edge 100A to trailing edge 100B. As previously described, it has been found that leading edge 100A of shroud 100 is exposed to higher operating temperatures than trailing edge 100B. In order to compensate for the difference in thermal growth, a lower CTE material is positioned near leading edge 100A such that leading edge 100A and trailing edge 100B undergo substantially similar amount of thermal growth during operation, even though leading edge 100A may be exposed to higher temperatures than trailing edge 100B. Shroud 100' (shown in phantom) illustrates the substantially uniform growth of leading edge 100A and trailing edge 100B of shroud 100 during operation of the gas turbine engine.

Figure 4B:
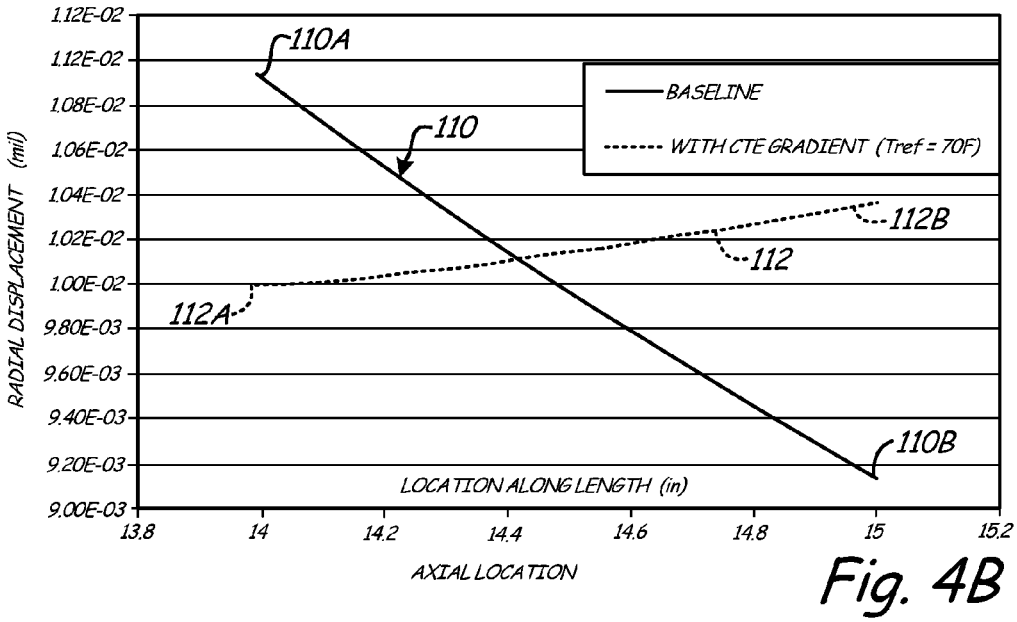
FIG. 4B is a graph illustrating the radial displacement of the shroud of FIG. 4A as a function of an axial position of the shroud.

FIG. 4B is a graph illustrating the radial displacement of shroud 100 measured as a function of an axial position (measured along the x-axis, as shown in FIG. 4A) of shroud 100. Line 110 represents radial displacement of a prior art shroud, which is formed of a material exhibiting a uniform CTE. Line 112 represents radial displacement of shroud 100, which is formed of two or more materials in an arrangement whereby a CTE of shroud 100 increases from leading edge 100A (shown in FIG. 4A) to trailing edge 100B (shown in FIG. 4A). Point 110A of line 110 corresponds to a radial displacement at a leading edge of the prior art shroud, while point 110B corresponds to a radial displacement at the trailing edge. Similarly, point 112A of line 112 corresponds to a radial displacement at leading edge 100A (shown in FIG. 4A) of shroud 100, while point 112B corresponds to a radial displacement at trailing edge 100B. As FIG. 4B illustrates, radial displacement of shroud 100 (represented by line 112) in accordance with a second embodiment is substantially more constant than the radial displacement of a prior art shroud (represented by line 110). The substantially uniform radial displacement of shroud 100 is attributable to the substantially uniform thermal growth of shroud 100 due to the varying CTE in an axial direction (i.e., in the x-axis direction).

Figure 5:
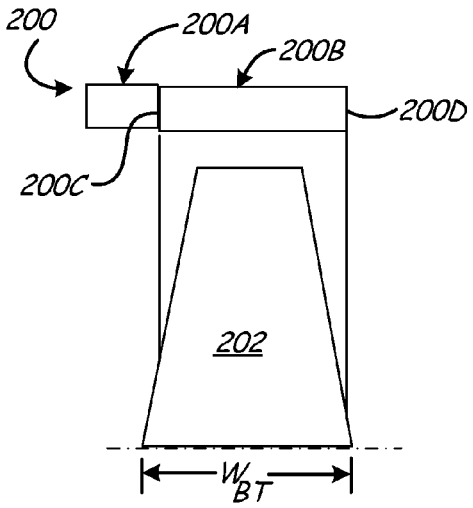
FIG. 5 is a schematic cross-sectional view of a third embodiment, where substantially uniform thermal growth is achieved as a result of extending the shroud beyond a width of an adjacent blade tip.

FIG. 5 is a schematic cross-sectional view of a third embodiment of shroud 200, which achieves substantially uniform thermal growth as a result of extending shroud 200 beyond width $W_{BT}$ of adjacent turbine blade tip. Specifically, extended portion 200A extends from main shroud portion 200B. During operation of a gas turbine engine, heat is typically transferred to shroud 200 by combustion gas. As blade 202 rotates, it incidentally circulates the hot gases towards main shroud portion 200B of shroud 200. Extended portion 200A, however, is subject to less heat transfer from blade 202 passing, because extended portion 200A is not directly adjacent to blade 202, and is therefore exposed to a lower heat transfer rate and encounters less thermal growth than main shroud portion 200B. Main shroud portion 200B is aligned with blade 202 and is in the direct path of the hot combustion gases as blade 202 passes under main shroud portion 200B. As a result, main shroud portion 200B undergoes a greater amount of thermal growth in response to the higher temperatures than extended portion 200A. Shroud 200 is designed to achieve substantially uniform growth because the smaller thermal growth of extended portion 200A helps constrain the thermal growth of leading edge portion of shroud 200B.

It has been found that without extended portion 200A, leading edge 200C of main shroud portion 200B is likely to undergo more thermal growth than trailing edge 200D. With the structure of shroud 200, however, the thermal growth of leading edge 200C of main shroud portion 200B is restrained by extended portion 200A and is discouraged to grow radially outward because extended portion 200A does not undergo as much thermal growth as leading edge 200C. Substantially uniform thermal growth of shroud 200 is achieved because leading edge 200C of main shroud portion 200A is no longer able to experience unlimited thermal growth.

Figure 6:
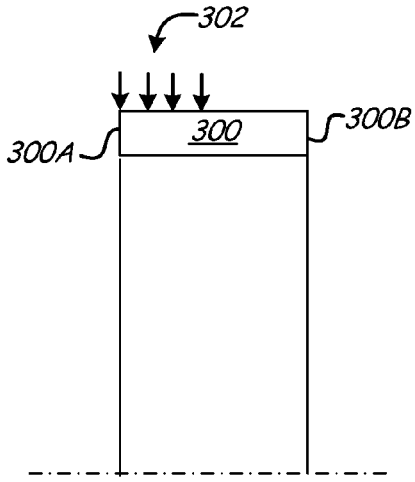
FIG. 6 is schematic cross-sectional view of a fourth embodiment of achieving substantially uniform thermal growth, where a clamping force is applied to a leading portion of a shroud in order to help constrain thermal growth of the leading portion.

FIG. 6 is schematic cross-sectional view of a fourth embodiment of shroud 300, whereby substantially uniform thermal growth is achieved by mechanically applying clamping force 302 to leading portion 300A of shroud 300 in order to help constrain thermal growth of leading portion 300A. Due to the tendency of leading portion 300A of shroud 300 to encounter more thermal growth than trailing portion 300B, the fourth embodiment of shroud 300 evens out the thermal growth of shroud 300 by clamping leading portion 300A and allowing unconstrained thermal expansion of trailing portion 300B. Any external clamping force 302 may be used to constrain leading portion 300A. Clamping force 302 may be, for example, attached to a gas turbine support case, which is typically adjacent to shroud 300. As those skilled in the art appreciate, the quantitative value of clamping force 302 is determined based on various factors, including the expected amount of thermal growth of leading portion 300A of shroud 300.

Figure 7A:
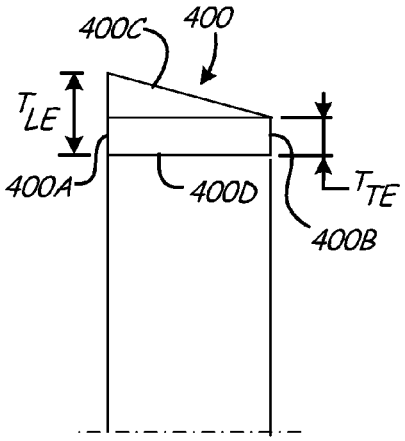
FIG. 7A is a schematic cross-sectional view of a fifth embodiment of achieving substantially uniform thermal growth, where a shroud includes a leading edge thickness greater than a trailing edge thickness.

FIG. 7A is a schematic cross-sectional view of a fifth embodiment of shroud 400, which extends from leading edge 400A to trailing edge 400B. Leading edge 400A has a thickness $T_{LE}$ while trailing edge 400B has a thickness $T_{TE}$, where $T_{LE}$ is greater than $T_{TE}$. Shroud 400 tapers from thickness $T_{LE}$ to thickness $T_{TE}$. Shroud 400 achieves substantially uniform thermal growth because the greater thickness $T_{LE}$ at leading edge 400A adds stiffness to leading edge 400A, which helps to constrain thermal growth at leading edge 400A. Furthermore, by increasing a thickness $T_{LE}$ at leading edge 400A, backside 400C of leading edge 400A is exposed to a lower temperature than front side 400D. As a result, backside 400C of leading edge 400A is inclined to undergo less thermal growth than front side 400D, which further helps constrain thermal growth of front side 400D of leading edge 400A. If backside 400C of leading edge 400A does not experience as much thermal growth as front side 400D, the thermal growth of front side 400D is constrained because backside 400C is resisting the radial expansion while front side 400D is radially expanding.

Figure 7B:
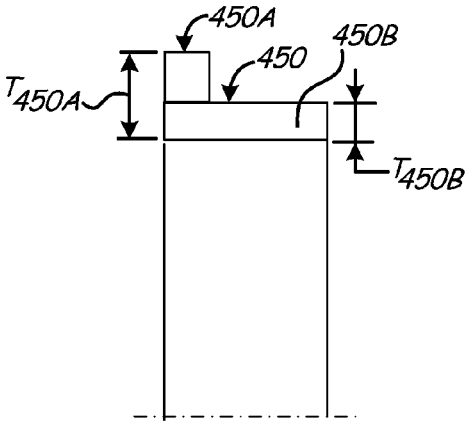
FIG. 7B is a schematic cross-sectional view of an alternate embodiment of the shroud of FIG. 7A.

FIG. 7B is a schematic cross-sectional view of shroud 450, which is an alternate embodiment of shroud 400 of FIG. 7A. Shroud 450 includes leading portion 450A and trailing portion 450B. As with shroud 400, leading portion 450A of shroud 450 includes a greater thickness $T_{450A}$ than trailing portion 450B thickness $T_{450B}$. However, rather than gradually tapering from thickness $T_{450A}$ to thickness $T_{450B}$, shroud 450 has discrete sections of thickness $T_{450A}$ and thickness $T_{450B}$.

Figure 8A:
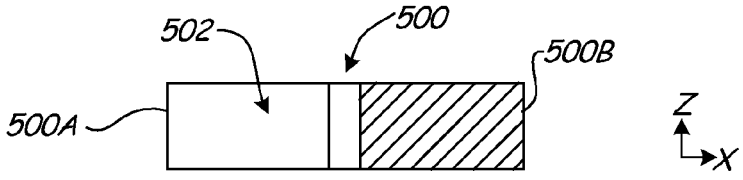
FIGS. 8A and 8B illustrate a sixth embodiment of achieving substantially uniform thermal growth, where a shroud includes a plurality of slots along a leading edge.
Figure 8B:
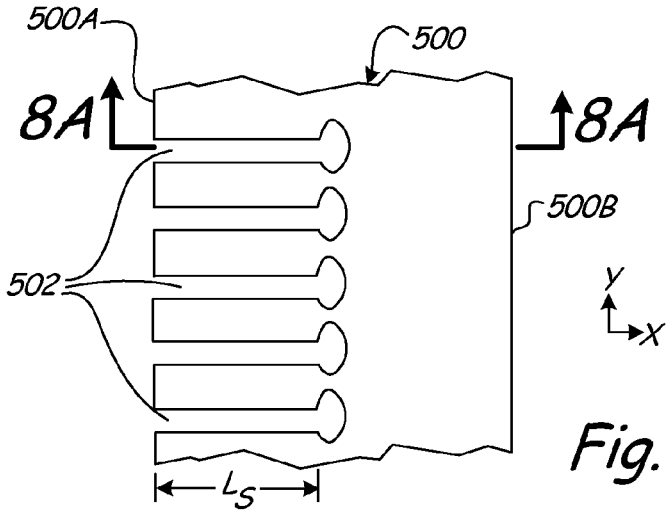

FIGS. 8A and 8B illustrate shroud 500 in accordance with a sixth embodiment. FIG. 8A is a cross-sectional view of shroud ring 500, while FIG. 8B is a plan view of shroud 500. Shroud 500 extends from leading edge 500A to trailing edge 500B, and includes a plurality of slots 502 extending from leading edge 500A towards trailing edge 500B. In the embodiment illustrated in FIGS. 8A and 8B, a length $L_s$ of each of slots 502 is approximately 40% of the shroud axial length. The slot width Ws is approximately 0.254 millimeters (10 mils) to about 0.508 millimeters (20 mils). However, both length $L_s$ and width Ws may be adjusted in alternate embodiments to accommodate shrouds of different sizes. Shroud 500 may include any suitable number of slots 502. In one embodiment, shroud 500 is a ring shroud and includes eight uniformly spaced slots 502.

Slots 502 break up the continuous hoop of material forming shroud 500 near leading edge 500A, which helps decrease the accumulated effect of thermal growth of leading edge 500A of shroud 500. By decreasing the accumulated effect of thermal growth of leading edge 500A, the amount of thermal growth of leading edge 500A is brought closer to the amount of thermal growth of trailing edge 500B, which helps achieve substantially uniform thermal growth of shroud 500. While slots 502 may cause shroud 500 to curl in the radial direction (i.e., the z-axis direction in FIG. 8A) near leading edge 500A, it is believed that the amount of curl is less than the expected thermal growth of shroud ring 500 without slots 502.

Figure 9:
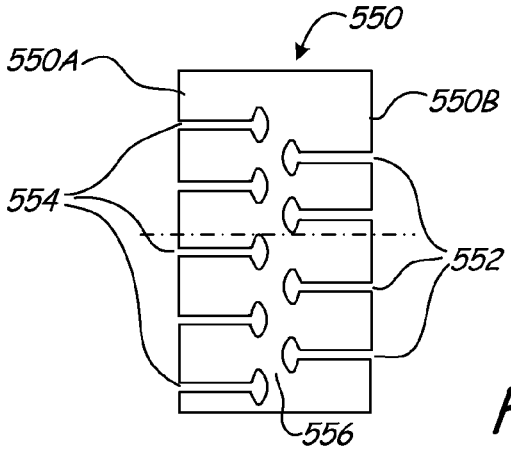
FIG. 9 illustrates an alternate embodiment of the shroud of FIGS. 8A and 8B, where the shroud includes a plurality of slots along both the leading edge and trailing edge.

FIG. 9 illustrates shroud 550, which is an alternate embodiment of shroud 500 of FIGS. 8A and 8B, where shroud 550 includes slots 552 extending from trailing edge 550B to leading edge 500A in addition to slots 554 extending from leading edge 500A to trailing edge 500B. In order to maintain the integrity of shroud 550, slots 552 and 554 are staggered such that each of the slots 552 along trailing edge 550B do not align directly with a slot 554 along leading edge 550A. Slots 552 and 554 define midsection 556, which further helps maintain the integrity of shroud 550.

The terminology used herein is for the purpose of description, not limitation. Specific structural and functional details disclosed herein are not to be interpreted as limiting, but merely as bases for teaching one skilled in the art to variously employ the present invention. Although the present invention has been described with reference to preferred embodiments, workers skilled in the art will recognize that changes may be made in form and detail without departing from the spirit and scope of the invention.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A shroud for a gas turbine engine, the shroud comprising:

a leading portion having a leading edge and a first set of circumferentially spaced slots at the leading edge that break up the leading portion into circumferentially spaced segments separated by the first set of slots, wherein a length of at least one of the first set of circumferentially spaced slots is approximately 40% of an axial length of the shroud; and a trailing portion adjacent to the leading portion, the trailing portion having a trailing edge.

2. The shroud of claim 1, wherein the first set of slots have an open end at the leading edge and extend towards the trailing edge to a closed end within the shroud, and extend radially through a full thickness of the leading portion of the shroud.

3. The shroud of claim 2, wherein the first set of slots extend in an axial direction.

4. The shroud of claim 1, wherein the trailing portion further comprises a second set of circumferentially spaced slots at the trailing edge that break up the trailing portion into circumferentially spaced segments separated by the second set of slots.

5. The shroud of claim 4, wherein the first set of slots and the second set of slots are staggered with respect to each other.

6. The shroud of claim 4, wherein the second set of slots extend in an axial direction.

7. The shroud of claim 1, wherein the length of each slot has a length is approximately 40% of an axial length of the shroud.

8. The shroud of claim 1, wherein at least one slot has an open end at the leading edge and extend towards the trailing edge to a closed end within the shroud, where opposite edges of the slot proximate the open are arranged substantially parallel to each other, and wherein the closed end defines a bulbous portion.

9. The shroud of claim 1, wherein at least one slot has a lollipop shape.

10. The shroud of claim 1, wherein a width of at least one of the first set of circumferentially spaced slots is in a range of approximately 0.254 mm (10 mils) to approximately 0.508 mm (20 mils).

11. The shroud of claim 1, wherein a width of at least one of the first set of circumferentially spaced slots is in a range of approximately 0.254 mm (10 mils) to approximately 0.508 mm (20 mils).

12. A shroud for a gas turbine engine, the shroud comprising:

a leading portion having a leading edge and a first set of circumferentially spaced slots at the leading edge that interrupt the leading portion in a circumferential direction, each of the first set of slots extends through a full thickness of the leading portion of the shroud and has a closed end within the shroud, wherein a length of at least one of the first set of circumferentially spaced slots is approximately 40% of an axial length of the shroud; and a trailing portion adjacent to the leading portion, the trailing portion having a trailing edge.

13. The shroud of claim 12, wherein each of the first set of slots has an open end at the leading edge and extend towards the trailing edge.

14. The shroud of claim 12, wherein the first set of slots extend in an axial direction.

15. The shroud of claim 12, wherein the trailing portion further comprises a second set of circumferentially spaced slots at the trailing edge that interrupt the trailing portion in the circumferential direction.

16. The shroud of claim 15, wherein the first set of slots and the second set of slots are circumferentially staggered with respect to each other.

17. The shroud of claim 12, wherein at least one slot has a lollipop shape.

* * * * *

UNITED STATES PATENT AND TRADEMARK OFFICE

CERTIFICATE OF CORRECTION

PATENT NO. : 8,801,372 B2
APPLICATION NO. : 13/668733
DATED : August 12, 2014
INVENTOR(S) : Jun Shi et al.

It is certified that error appears in the above-identified patent and that said Letters Patent is hereby corrected as shown below:

In the Claims

Claim 7, Col. 10, Lines 15-16
Delete "has a length"

Signed and Sealed this
Twenty-first Day of October, 2014

Michelle K. Lee

Michelle K. Lee
*Deputy Director of the United States Patent and Trademark Office*